United States Patent [19]

DeAmicis

[11] 3,938,218

[45] Feb. 17, 1976

[54] EXTENSIBLE CLEANING TOOL

[76] Inventor: Ferdinando DeAmicis, 6401 Oliver Ave. South, Richfield, Minn. 55423

[22] Filed: Nov. 7, 1973

[21] Appl. No.: 413,432

[52] U.S. Cl. ..... 15/401; 15/405; 15/414; 285/302

[51] Int. Cl.[2] ..... A47L 9/06

[58] Field of Search..... 15/315, 316 R, 393, 395, 15/401, 405, 406, 408, 414; 285/302

[56] References Cited

UNITED STATES PATENTS

| | | | |
|---|---|---|---|
| 1,550,305 | 8/1925 | Dreischerf | 15/405 X |
| 1,769,944 | 7/1930 | Crisp | 15/405 X |
| 2,617,933 | 11/1952 | Noel | 285/302 X |
| 2,623,234 | 12/1952 | Brown | 15/414 X |

FOREIGN PATENTS OR APPLICATIONS

| | | | |
|---|---|---|---|
| 843,262 | 7/1952 | Germany | 15/315 |

*Primary Examiner*—Harvey C. Hornsby
*Assistant Examiner*—C. K. Moore
*Attorney, Agent, or Firm*—James R. Haller; H. Dale Palmatier

[57] ABSTRACT

A telescoping cleaning tool adapted to remove debris and the like from a poorly accessible surface. The tool includes telescoping inner and outer tubes wherein one end of one of the tubes is adapted to receive air under pressure, as from an air nozzle, and the opposite end of the other tube is provided with a sharpened edge for scraping debris and the like from a surface. An orifice is provided adjacent the sharpened edge for directing the air under pressure against such debris. The one tube is preferably provided with a handle near its air-receiving end so that an operator may grasp the handle with the fingers and press the air-receiving end into an air nozzle held in the palm of the hand, thereby permitting the tool to be used with one hand only. Upon application of air pressure, the tube bearing the sharpened edge is caused to extend axially outwardly of the other tube, and the air under pressure is directed through the orifice in the end of the extended tube so as to blow away debris from a surface as the same is loosened by scraping with the sharpened edge. Means are provided to prevent the member having the sharpened edge from completely escaping, when extended, from the other member.

9 Claims, 14 Drawing Figures

FIG. 1
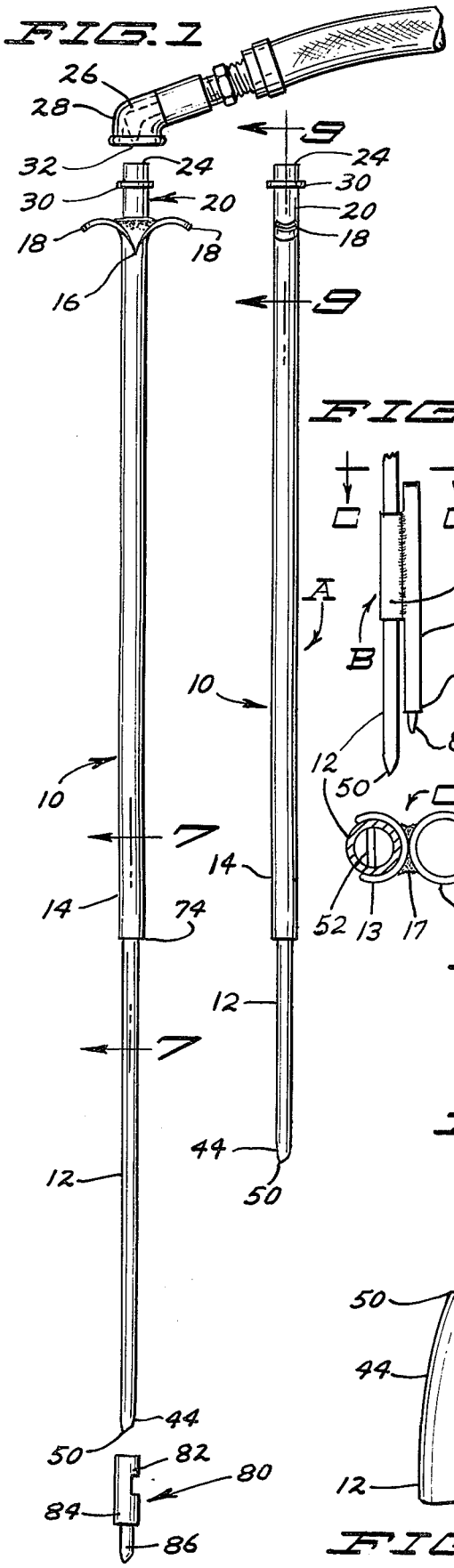
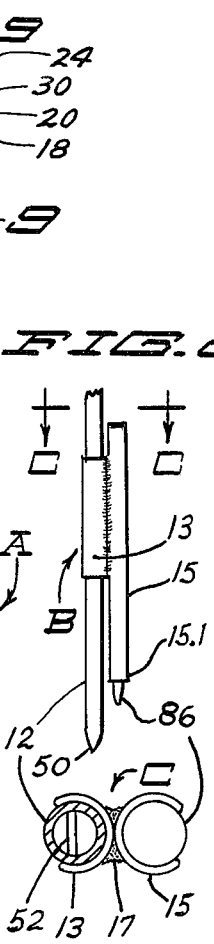
FIG. 2
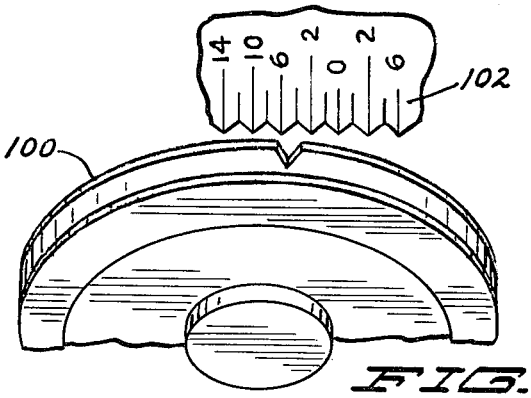
FIG. 3
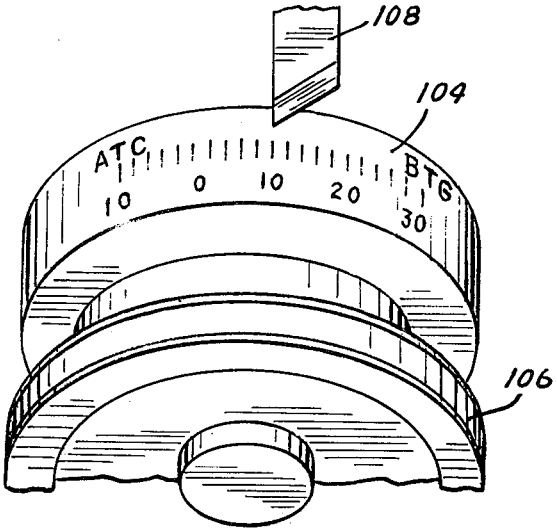
FIG. 4
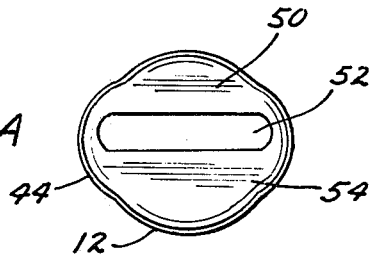
FIG. 5A
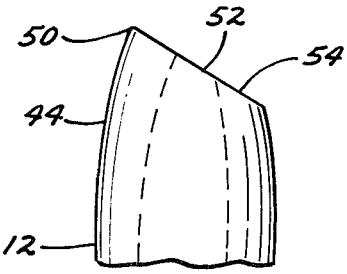
FIG. 5B
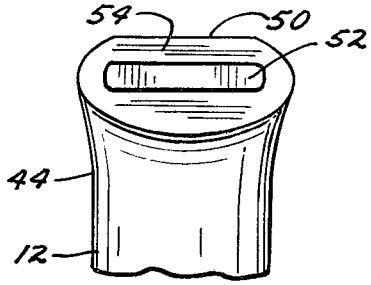
FIG. 5C FIG. 6
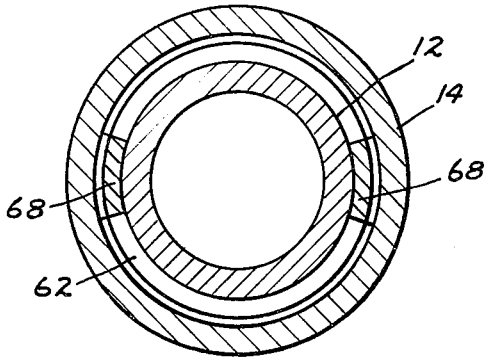
FIG. 8
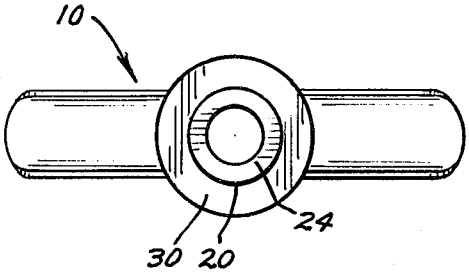
FIG. 9
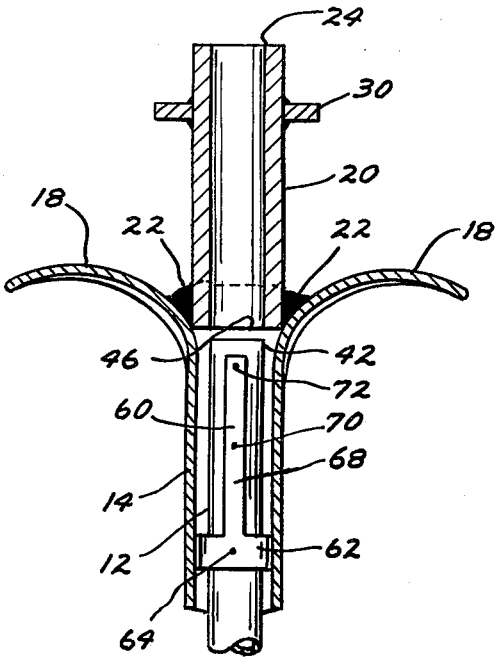
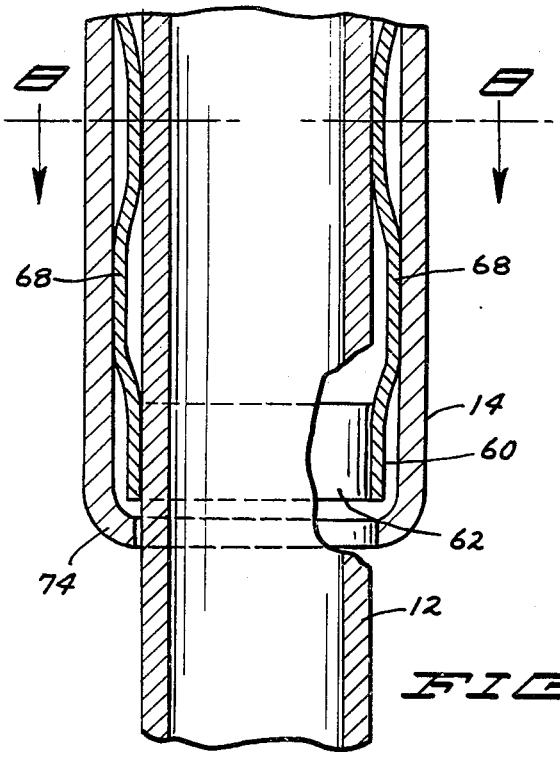
FIG. 7
FIG. 12
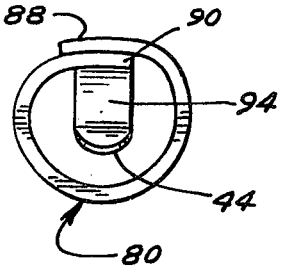
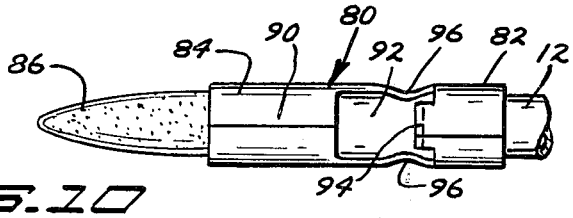
FIG. 10
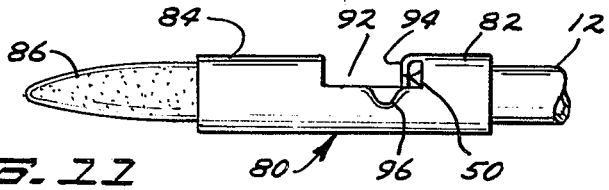
FIG. 11

EXTENSIBLE CLEANING TOOL

BACKGROUND OF THE INVENTION

The present invention relates to cleaning tools in general and more particularly to cleaning tools adapted for the removal of debris from relatively inaccessible areas.

The timing adjustment scales of automobile engines, particularly those of American manufacture, are often difficult for a mechanic to view. Such timing scales often are located between the engine and radiator, and a considerable distance below the upper surface of the engine, and they become easily coated with dust, oil, and other debris. The cleaning of such scales and the like in automobiles has long been a distasteful and time-consuming chore, since it entails reaching down into the bowels of the engine with a rag, ineffectually scraping at dirt with a pointed stick or the like, etc.

BRIEF SUMMARY OF THE INVENTION

Briefly, the telescoping cleaning tool of the invention comprises telescoping inner and outer tubes in coaxial, longitudinal sliding engagement with one another. One of the tubes has an end adapted to receive air under pressure, as from an air nozzle, and the other tube has a sharpened, debris-scraping end which is remote from the air-receiving end of the first-mentioned tube. The air-receiving end of the one tube communicates with an orifice in the sharpened end of the other tube to direct air under pressure against debris and the like. The tool includes means preventing complete disengagement of the inner and outer tubes, and further includes means responsive to the flow of air under pressure into one tube to cause the other tube to telescopically extend therefrom.

BRIEF DESCRIPTION OF THE DRAWING

FIG. 1 is a front elevational view of a cleaning tool of the invention in its extended position and showing an air hose and nozzle above the air-receiving end of the tube and a scribe holder below the tool;

FIG. 2*a* is a side view of the cleaning tool of FIG. 1 shown in retracted position, FIG. 2*b* is a broken away, side view of a tool of the invention with a different scribe holder attached, and FIG. 2*c* is a cross-sectional view taken along line *c—c* of FIG. 2*b*;

FIGS. 3 and 4 are perspective views, partially broken away, exemplifying timing gears which may be cleaned with the tool of the present invention;

FIGS. 5*a*, 5*b*, and 5*c* are top, side and front views, respectively, of the sharpened end of a tool of the invention, shown partially broken away;

FIG. 6 is a top view of the tool shown in FIGS. 1 and 2;

FIG. 7 is a partially broken away, cross-sectional view of a tool of the invention, taken along lines 7—7 of FIG. 1;

FIG. 8 is a cross-sectional view taken along line 8—8 of FIG. 7;

FIG. 9 is a view in partial cross section and partially broken away taken along lines 9—9 of FIG. 2;

FIGS. 10 and 11 are top and side views, respectively, of a scribe-holder attachment shown mounted on the sharpened end of a tool of the invention; and FIG. 12 is an end view of the scribe-holder attachment shown in FIGS. 10 and 11.

Referring now to FIG. 1, the cleaning tool 10 includes inner and outer telescoping tubes 12 and 14, which preferably are circular in cross section and substantially uniform in diameter, respectively, throughout their lengths. The upper end of the outer tube 14 has been split for a short distance, as shown at 16 in FIG. 1, and the split edges have been turned outwardly to form handles 18. Welded to the upper end of the outer tube 14 is tubular connector 20, as best shown in FIG. 9. Fillet welds 22 extend circumferentially of the connector 20 so as to render the joint between it and the end of outer tube 14 airtight. The connector 20 terminates in an end 24 adapted to receive air under pressure from air nozzle 26. Nozzle 26 may be of the type known to the art and commonly employed in automobile service stations throughout the United States. This nozzle incorporates a valve having a tapered valve stem 28 (shown in dotted lines in FIG. 1) which becomes centered in the end 24 of connector 20 and which, when depressed, permits air to flow into the connector. The nozzle 26 may be held in the palm of the hand, and the fingers of the hand may grasp the handle 18 to force the connector end 24 against the valve stem 28 to open the nozzle valve end, permitting air under pressure to enter the connector. The amount of air may thus be continuously adjusted by means of the pressure exerted by the palm of the hand against the nozzle 26. An outwardly extending flange 30 which may be welded to the outer surface of connector 20 is adapted to contact the lower surface 32 of the air nozzle to maintain proper orientation between the connector 20 and nozzle 26 and also to prevent the end of the connector from penetrating too deeply into the nozzle.

The inner tube 12 has proximal and distal ends with respect to the air-receiving end of the outer tube 14, as shown respectively in FIG. 9 and FIGS. 1, 2, 5*a*, 5*b* and 5*c*, and as designated 42 and 44, respectively. Proximal end 42 preferably terminates in a flat end, the walls thereof providing an end surface 46 which is normal to and at least partially in line with the flow of air through the outer tube 14 so that air pressure in the outer tube pushes the inner tube 12 in a downward direction until it reaches its maximum extension as shown in FIG. 1. The distal end 44 of tube 12 terminates in a sharpened and straight chisel edge 50 (FIGS. 5*a*, 5*b* and 5*c*) which is substantially normal to the direction of air flow through the tubes 12 and 14. Adjacent the chisel edge 50 in the distal end 44 is a restricted orifice 52 which preferably is of greater width in a direction parallel to the chisel edge 50 than in a direction normal thereto, as shown best in FIG. 5*c*. The chisel-edged, orificed end 44 can be readily produced by first making a transverse crimp or crease in inner tube 12, and then grinding away the excess material to form a flat surface 54 at the end of this tube which is at an angle of, for example, 60° to the longitudinal axis of the tube and parallel to the preexisting transverse crimp line. This method of manufacture not only provides the distal end 44 with a sharp, straight chisel edge 50, but also reduces the internal cross-sectional area of the tube 12 at the point of orifice 52, as shown in FIG. 5*b*. In addition, this method of manufacture tends to widen the distal end 44 of the inner tube 12 to provide a suitably wide cleaning area, and provides the orifice 52 with a greater dimension parallel to the chisel edge than perpendicular thereto, as shown in FIGS. 5*a* and 5*c*.

Positioned intermediate the proximal and distal ends of the inner tube 12 are one or more bushings such as circumferential springs 60 (FIGS. 7, 8 and 9). Each bushing may be made of a single piece of material, such as spring steel, and may comprise a band 62 which snugly fits the outer surface of inner tube 12 and extends circumferentially thereof, the band being attached to the tube by one or more spot welds 64. Each band has a plurality of spring strips 68 extending therefrom in a direction substantially parallel to the direction of air flow, and each strip is sinuously configured as shown in FIG. 7 as to alternately contact the juxtaposed walls of the outer and inner tubes 14 and 12. Additional spot welds 70 and 72 (FIG. 9) may be employed to attach strips to the outer walls of the inner tube 12 at points of contact therebetween to hold the strips in their sinuous configuration. The bushings such as spring 60 serve to hinder somewhat the axial movement of one tube within the other, and serve also to maintain the tubes in substantial axial alignment when the apparatus is in the extended position.

The lower end 74 of the outer tube 14 may be turned in slightly by crimping or the like, as shown in FIG. 7, so that the opening bounded by the periphery of the turned-in walls is just large enough to permit the inner tube 12 to slide therethrough, but small enough to prevent the passage of the band 62 therethrough. The band 62, in combination with the turned-in lower end 74 of the outer tube 14, prevents the inner tube from completely escaping from the outer tube and thus limits the length to which the cleaning tool may be extended. The turned-in walls at the lower end 74 of the outer tube also tend to remove adhered grease and other debris from the surface of the inner tube 12 when the inner tube is retracted after use, thus reducing to a minimum the amount of debris which is permitted to enter the space between the tubes 12 and 14.

A hollow, longitudinal scribe holder 80 (FIGS. 10 11 and 12) is provided with one end 82 adapted to be attached to the sharpened end 44 of tube 12, the other end 84 thereof being adapted to rigidly receive a scribing instrument such as a piece of chalk 86. The scribe holder may be formed of a single piece of springy material, such as spring steel which may be rolled into a substantially tubular structure with the edges 88 and 90 thereof overlapping, as shown in FIG. 12. The overlapping edges preferably are flattened somewhat so as to more closely approximate the flattened outer surface of the sharpened end 44 of tube 12. The spring nature of the spring steel or other material employed in the scribe holder permits edges 88 and 90 to uncoil slightly for slipping over the widened sharpened end 44 of the inner tube. In similar fashion, the overlapping edges 88 and 90 at the other end of the scribe holder permits these edges to uncoil slightly against spring pressure for the insertion in that end of a piece of chalk 86, or other scribing material. The scribe holder is provided with an aperture 92 intermediate the ends 82 and 84 thereof to permit air under pressure issuing from orifice 52 to escape harmlessly to the side rather than bear on the scribing material 86. In a preferred embodiment, the aperture 92 is provided by making a U-shaped cut through the walls of the scribe holder at a point intermediate its length with the legs of the "U" pointing toward the end 82 of the scribe holder. The wall material included within the legs of the "U" may then be bent inwardly, as shown best in FIG. 11, to provide a wall against which the sharpened edge 50 of the inner tube 12 may bear during a scribing operation and which deflects air issuing from the orifice 52 away from the chalk 86. Further, the walls of the scribe holder adjacent the bent-down wall 94 may be punched inwardly, as shown at 96 to provide internally extending projections which further bear upon the sharpened end 44 of inner tube 12 to prevent this tube from advancing forward to block the aperture 92. bent FIGS. 2*b* and *c* depict a scribe holder which is slidably but removably mounted along the length of the inner tube 12 so that it may be pushed downwardly along the tube 12 to afford contact between the scribe and a timing scale to be marked. This scribe holder includes a pair of parallel, thin-walled tubes 13 and 15 of springy metal or plastic, each split lengthwise and spread into a C-shaped cross-sectional configuration, as shown most clearly in FIG. 2*c*. The split, longitudinal edges of the tube 13 are spread apart a sufficient distance so that the split edges may contact the surface of the inner tube 12 and the tubes may be forced together, the split edges of the tube 13 thus being forced further apart to pass diametrically over the tube 12 and to then return slightly due to the springy nature of the tube 13, capturing the tube 12 as shown best in FIG. 2*c*. In similar fashion, a scribe such as chalk marker 15.1 is captured by the other split tube 15, although the chalk may be merely inserted from the lower end 15.1 of the split tube 15 if desired. Diametrically opposite their split ends, the tubes 13 and 15 are welded together by welds 17 along their entire mutual length or at spots along their mutual length affording a rigid, non-twisting union between the split tubes, the tube 15 extending a short distance below the tube 13. In use, the split tube 13 is retained on the inner tube 12 as the latter is used to remove debris from a timing scale, as will be more fully described below, and then the split tube is pushed slidingly downward along the inner tube until the chalk 86 extends beyond the end 50 of the inner tube, whereupon a chalk mark may be scribed on the timing scale.

FIGS. 3 and 4 respectively depict types of timing devices found in present day automobiles of American manufacture. FIG. 3 depicts a timing pulley 100 and a stationary scale 102 whereas, in FIG. 2, the scale 104 is affixed to and rotates with the pulley 106, and includes a stationary pointer 108. The markings "ATC" and "BTC" refer to "after top center" and "before top center", and the numbers associated therewith relate to the differential between the instant of firing of a spark plug and the instant that a piston reaches its top-most position within a cylinder of an automobile engine. By the use of a strobe light, a mechanic can determine which of the scale markings line up with the pointer at the instant a given spark plug is fired, and can then adjust the "timing" accordingly. It is manifest that, in order to properly perform this job, a mechanic must be able to clearly view the scales 102 and 104 of various timing mechanisms.

To remove debris from the scales 102 and 104, an operator will place an air hose nozzle such as that depicted at 26 in FIG. 1 in the palm of his hand, and with the fingers of that hand he will grasp the outwardly extending handle 18 to cause the end 24 of the connector 20 to enter the nozzle. By applying a squeezing pressure with the hand, the operator causes air under pressure to be forced into the end 24 of the connector and thence to flow into outer tube 14. The air pressure causes the inner tube 20 to extend outwardly of the outer tube 14 until the band 62 contacts the inwardly turned lower wall 74 of the outer tube. Of course the mechanic will guide the extended end of the tubes with his other hand. Air maintains the tubes in fully extended position so that the mechanic may exert a considerable mechanical force through the extended tube to the end 50 in scraping away debris. The air from air nozzle 22 passes from the outer tube 14 into the inner tube 12 and exits through orifice 52. Air itself will remove a substantial portion of the dirt and debris. The sharpened end 50 of the extended inner tube 12 is employed by the operator to dislodge the remaining grease, oil, dust, and other debris from the surface of the scales 102 and 104, and this debris is further removed and blown away by the jet of air issuing from orifice 52. In actual practice, it has been found that timing scales of the type depicted in FIGS. 3 and 4 may be thus suitably cleared of debris in a matter of seconds. The amount of air jetting forth from orifice 52 is easily controlled by the amount of hand pressure exerted by the operator on the air nozzle 26. Air flow may thus be started or stopped at will. After completion of the cleaning operation, the scribe holder may be connected to the sharpened end of the apparatus so as to permit the mechanic to place a reference chalk mark on the timing scale. The spring strips 68 ordinarily will apply sufficient frictional pressure between the inner and outer tubes so that extension of the apparatus is maintained during the marking operation without air flow through the tubes. When the cleaning and marking operations are completed, the operator merely collapses the tubes 12 and 14 together as shown in FIG. 2.

While I have described a preferred embodiment of the present invention, it should be understood that various changes, adaptations and modifications may be made therein without departing from the spirit of the invention and the scope of the appended claims.

What I claim is:

1. Telescoping cleaning tool adapted to remove debris and the like from timing adjustment scales of an automobile, comprising:

telescoping, hollow, inner and outer tubes in axial sliding engagement with one another, one tube having an end adapted to receive air under pressure, and the other tube having an end remote from the air-receiving end of said one tube, said remote end terminating in an end transversely crimped and machined at an angle to the tube axis and parallel to the crimp to provide both a sharp, straight, chisel edge transverse of the longitudinal axis of the tubes and an elongated end orifice closely adjacent the chisel edge and which has a cross-section area less than that of said other tube, the orifice having a greater dimension parallel to the chisel edge than perpendicular thereto and communicating with said air-receiving end to direct air under pressure against debris;

said other tube providing means responsive to the flow of air under pressure into said one tube to cause said other tube to telescopically extend therefrom; and means preventing complete disengagement of said inner and outer tubes.

2. The cleaning tool according to claim 1 wherein said sharpened end is on said inner tube and wherein the other end of the inner tube has sufficient surface area normal to the direction of air flow as to cause said inner tube to slidably extend outwardly from the outer tube upon application of air under pressure to the air-receiving end of the outer tube.

3. The cleaning tool according to claim 1 wherein said inner and outer tubes are respectively substantially uniform in cross section, with the proviso that the cross-sectional area available for air flow at said orifice is smaller than the cross-sectional area available for air flow intermediate the ends of said inner tube.

4. The cleaning tool according to claim 1 wherein said means preventing disengagement of the tubes comprises a bushing positioned between said inner and outer tubes and affixed to the inner tube and adapted to retain said tubes in substantially axial alignment when said inner tube is extended from said outer tube.

5. The cleaning tool according to claim 4 wherein said bushing comprises a band attached circumferentially to the outer surface of the inner tube and having a plurality of spring strips extending therefrom along said outer surface in substantial alignment with the direction of air flow, each spring strip alternately contacting facing surfaces of said inner and outer tubes.

6. The cleaning tool according to claim 1 wherein said air-receiving end is adapted to receive a pressure-actuatable nozzle of an air line and wherein said outer tube includes a handle projecting laterally outwardly therefrom adjacent said air-receiving end, whereby with one hand an operator may grasp said handle with the fingers and pressurally apply with the palm the air nozzle to said air-receiving end.

7. The cleaning tool according to claim 1 including a hollow, longitudinal scribe holder attachable to said sharpened end, said scribe holder having a spring-loaded end for rigid attachment to said sharpened end, an opposite, open end adapted to rigidly receive a scribing instrument, and an aperture intermediate its ends to permit air under pressure from said orifice to escape therethrough.

8. The cleaning tool according to claim 1 including a scribe holder comprising a pair of parallel tubes each having a lengthwise split and having spaced, split longitudinal edges, the split tubes being rigidly joined together in parallel orientation, one split tube being slidably but firmly mounted to the tube with the sharpened end and the other tube having a scribe projecting from its lower end, whereby the scribe holder may be pushed slidingly downward on the tube to which it is joined until the scribe extends beyond the sharpened end of the tool.

9. A telescoping cleaning tool adapted to remove debris from timing adjustment scales of an automobile and comprising:

a. an outer tube having open ends of which one is adapted to receive air under pressure from a pressure-actuatable nozzle;

b. an inner tube fitted within said outer tube in sliding engagement therewith, said inner tube having proximal and distal ends with respect to the air-receiving end of the outer tube, said proximal end terminating in an end surface at least partially in the path of the flow of air under pressure through said outer tube, and said distal end terminating in an end transversely crimped and machined at an angle to the tube axis and parallel to the crimp to provide both a debris-scraping chisel edge which is substantially normal to the direction of air flow through said tubes and an elongated orifice therein closely adjacent and aligned with said chisel edge and adapted to direct said air under pressure against debris adjacent the edge;

c. A band rigidly attached circumferentially to the outer surface of said inner tube and having a plurality of spring strips extending therefrom substantially parallel to the direction of air flow, each spring strip being sinuously curved so as to alternately contact juxtaposed walls of the inner and outer tubes to restrain movement tending to displace the coaxial alignment therebetween;

the end of said outer tube opposite said air-receiving end being turned inwardly about its periphery to an extent just sufficient to restrain passage to said band therethrough, said outer tube further having a handle extending laterally outwardly adjacent the air-receiving end thereof and adapted to be held by the fingers of one hand as the palm of that hand urges a pressure-actuated air nozzle into engagement with said air-receiving end.

* * * * *